United States Patent [19]

Heuvelmans et al.

[11] 4,004,171

[45] Jan. 18, 1977

[54] GAS-AND/OR VAPOR DISCHARGE LAMP

[75] Inventors: Jean Johan Heuvelmans; Hendricus Franciscus Joannes Jacobus van Tongeren; Jan Evert Van der Werf, all of Eindhoven, Netherlands

[73] Assignee: U.S. Philips Corporation, New York, N.Y.

[22] Filed: Mar. 22, 1976

[21] Appl. No.: 668,827

[30] Foreign Application Priority Data

Apr. 1, 1975 Netherlands ..... 7503825

[52] U.S. Cl. ..... 313/15; 313/17; 313/44; 313/174; 313/180

[51] Int. Cl.[2] ..... H01J 61/24

[58] Field of Search ..... 313/180, 174, 15, 17, 313/44

[56] References Cited

UNITED STATES PATENTS 3,946,262 3/1976 Keeffe et al. ..... 313/174

*Primary Examiner*—Palmer C. Demeo
*Assistant Examiner*—Darwin R. Hostetter
*Attorney, Agent, or Firm*—Frank R. Trifari; George B. Berka

[57] ABSTRACT

The invention relates to a gas and/or vapor discharge lamp which is provided with a discharge tube and an outer bulb which envelops this tube, whilst the heat insulation in the space between the discharge tube and the outer bulb can be changed.

According to the invention the heat insulation is changed by means of a reversible hydrogen getter which is located in the space between the outer bulb and the discharge tube. In this way it is obtained that the lamp can either be operated without a stabilizing ballast or that it is less sensitive to variations in the mains supply.

4 Claims, 2 Drawing Figures

GAS-AND/OR VAPOUR DISCHARGE LAMP

The invention relates to a gas and/or vapour discharge lamp provided with a discharge tube and an outer bulb which envelops this tube, means being present to change the heat insulation in the space between the discharge tube and the outer bulb.

A known discharge lamp of the specified type is, for example, described in the German patent specification No. 574,578. A disadvantage of this known lamp is that to change the heat insulation in the space between the outer bulb and the discharge tube an installation for cooling air is required.

The invention has for its object to provide the possibility to change the heat insulation in the lamp indicated in the preamble in a very simple manner.

A gas and/or vapour discharge lamp according to the invention provided with a discharge tube and an outer bulb which envelops this tube, a means being present to change the heat insulation in the space between the discharge tube and the outer bulb, is characterized in that this means consists of a reversible hydrogen getter which is located in the space between the discharge tube and the outer bulb of the lamp, whereby this getter releases hydrogen if its temperature increases and absorbs hydrogen if its temperature decreases.

An advantage of a lamp according to the invention is that no separate gas reservoir outside the lamp is required. A further advantage of the lamp according to the invention is sometimes also that if the current strength through the discharge tube increases for some reason or another, the temperature of the discharge tube which is increased thereby will also be imparted to the reversible hydrogen getter, so that the latter will quickly release more hydrogen gas. Consequently the heat insulation in the space between the discharge tube and the outer bulb will decrease. This is favourable as this enhances cooling of the discharge tube through which an excessive current flows. The result is amongst other things that a lamp according to the invention is sometimes less sensitive to mains voltage variations than a similar lamp which, however, is not provided with a reversible hydrogen getter better the discharge tube and the outer bulb.

The discharge tube according to the invention may, for example, be a discharge lamp which is stabilized by a stabilizing ballast.

In a preferred embodiment of a metal vapour discharge lamp according to the invention there is a temperature range of the discharge tube within which it holds that at a constant temperature the voltage-versus-current characteristic has a positive range, whilst — at a constant electric voltage across the discharge tube — the discharge tube has, in its operating condition, a positive temperature-versus-current characteristic.

An advantage of this preferred embodiment is that for this lamp, owing to the combination of the reversible hydrogen getter between the discharge tube and the outer bulb on the one hand and the indicated characteristics on the other hand, the lamp may be operated with not more than a relatively small stabilizing ballast.

In a further improvement of said last-mentioned preferred embodiment the lamp is a low pressure sodium vapour discharge lamp and the reversible getter is located near a heating element included in an auxiliary circuit, whilst the magnitude of the current through the heating element depends on the magnitude of the current through the discharge tube, in such a way that a large current through the discharge tube causes a relatively large current to flow through the heating element, the connections of electrodes of the discharge tube to imput terminals of the device being substantially free from stabilizing ballasts.

An advantage of this preferred embodiment is that the lamp may be operated without a separate stabilizing ballast. This ballast-less operation of the lamp is possible because any large current through the discharge tube which results in an increased temperature of the discharge tube, is offset by the poor heat insulation due to the fact that the heating element then receives more current so that the getter introduces more gas between the outer bulb and the discharge tube.

It is conceivable that the gas of the reversible getter is confined to only part of the space between the discharge tube and the outer bulb, for example a gastight compartment.

In a further preferred embodiment of a gas and/or vapour discharge lamp according to the invention the lamp is a high pressure metal vapour discharge lamp and the reversible hydrogen getter is in intimate heat contact with an end of the discharge tube.

An advantage of this preferred embodiment is that now the influence of mains variations on the luminous behaviour of the lamp is decreased. At a somewhat larger mains voltage the discharge tube will carry a somewhat larger current and consequently get warmer. If an end of the discharge tube, in which as a rule the coldest spot of the discharge tube is located, is provided with the above said reversible gas getter, then that getter will also be raised to a higher temperature and relese more gas. Consequently the heat insulation of the discharge tube gets poorer so that the change in temperature — also of the coldest spot of the discharge tube — remains limited so that the luminous behaviour of the lamp is only little affected.

The invention will now be further explained with reference to a drawing in which.

Figure 1:
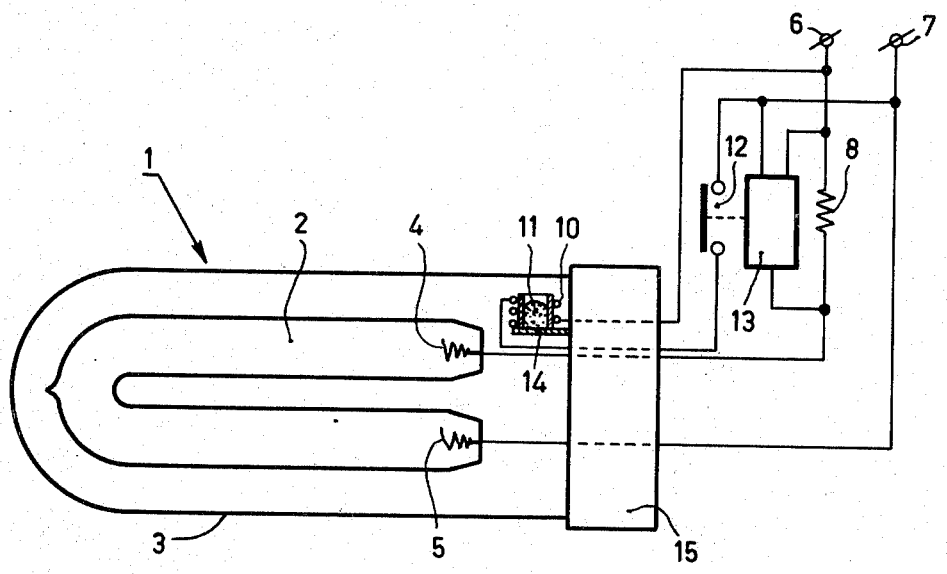
FIG. 1 shows a device according to the invention provided with a low pressure sodium vapour discharge lamp.

Reference 1 in FIG. 1 is a diagrammatical drawing of a low pressure sodium vapour discharge lamp . This lamp is provided with a U-shaped discharge tube 2 which is surrounded by an outer bulb 3. References 4 and 5 indicate electrodes in the respective ends of the discharge tube 2. References 6 and 7 are input terminals intended for connection to a d.c. voltage source of approximately 100 volts. Terminal 6 is connected to a resistor 8 of approximately one Ohm. The other side of the resistor 8 is connected to the electrode 4. The input terminal 7 is connected to the electrode 5. A junction point between the terminal 6 and the resistor 8 is connected to a heating element 10 which is located between the discharge tube 2 and the outer bulb 3 of the lamp 1. The heating element 10 is wound around a tray which contains a reversible hydrogen getter 11. The tray is fixed to a glass support 14. The getter 11 is known per se and consists mainly of titanium hydride. The other side of the heating element 10 is connected to a contact 12 of a relay in a control element 13. The other side of this contact is connected to the terminal 7. The control element 13, which also comprises a level detector, shunts the resistor 8. For its supply this element 13 is also connected to the terminal 7. Reference 15 indicates the lamp base.

The described device of FIG. 1 operates as follows. When the terminals 6 and 7 are connected to the d.c. voltage source high frequency high voltage is also applied for a short time between the electrodes 4 and 5 by an auxiliary device not shown. The lamp ignites subsequently. In this situation first the lamp current which flows via 6, 8, 4 through the discharge tube 2 to the electrode 5 and terminal 7 increases. Initially this current is that small that the contact 12 is open, i.e. the getter 11 is cold and the gas pressure in the space between the discharge tube and the outer bulb is consequently small; so the heat insulation is good. The lamp is heated still further. At a given moment the lamp current becomes that high that the contact 12 is closed by the control element 13. Consequently the heating element 10 receives current. The resultant heat causes the reversible getter 11 to expel some hydrogen gas, which causes the heat insulation in the space between the discharge tube 2 and the outer bulb 3 to decrease, so that an increased cooling action of the discharge tube is effected. This cooling action is stronger than the heating of the tube so that the discharge tube 2 cools somewhat. This means that then the lamp current decreases again so that contact 12 opens again. Consequently also the hydrogen pressure in the space between the outer bulb 3 and discharge tube 2 gets smaller, so that the discharge tube 2 is raised to a higher temperature etc.

In an embodiment of the device of FIG. 1 the length of the discharge path between the electrodes 4 and 5 is approximtely 80 centimeters. Besides sodium the discharge tube 2 also comprises rare gas having a pressure of approximately 5.5 Torr and consisting of 99% neon and 1% argon. The hydrogen pressure in the space between the outer bulb 3 and the discharge tube 2 varies between approximately $10^{-5}$ Torr and $10^{-2}$ Torr. In the operating condition of the lamp the lamp current varies between approximately 0.85 amperes and 0.95 amperes. The average of the lamp is approximately 90 Watts.

At the prevailing temperature of the discharge tube 2 of approximately 260° C on average the voltage-versus-current characteristic of the discharge tube is positive, and furthermore at a value of the mains voltage across the terminals 6 and 7 — the auxiliary circuit being disconnected — the temperature-versus-current characteristic of the discharge tube is also positive.

Figure 2:
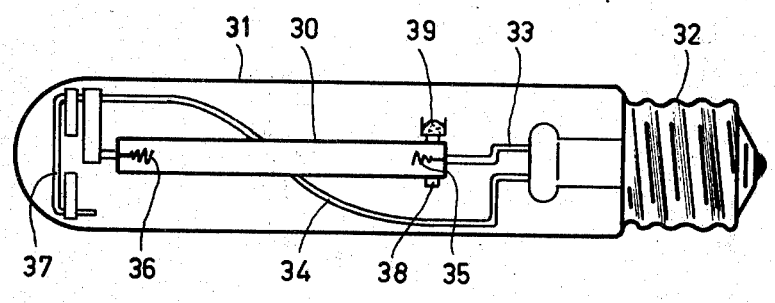
FIG. 2 is a high pressure metal vapour discharge lamp according to the invention.

In FIG. 2 reference 30 indicates a discharge tube of a high pressure sodium vapour discharge lamp. Reference 31 is an outer bulb which envelops this discharge tube 30. Reference 32 indicates a lamp base. References 33 and 34 are electrical connections which are located between the discharge tube 30 and the outer bulb 31 and which are used to supply the electrodes 35 and 36 respectively which are located in the ends of the discharge tube 30. Reference 37 is a support for supporting the discharge tube 30 with respect to the outer bulb 31. Clamped around the end of the discharge tube in which the electrode 35 is located is a bracket 38 which carries a small can which is provided with a reversible hydrogen getter 39. This getter mainly consists of cerium hydride. This getter might, for example, alternatively consist of yttrium hydride. Also the end of the discharge tube 30 which comprises the electrode 36 may be provided with a similar bracket and a can containing the relevant getter. These getters are then located near the coldest spots in the discharge tube, namely behind the electrodes. The temperature of these tube ends is approximately 1000° Kelvin.

The getter 39 is used to vary the hydrogen pressure in the space between the discharge tube 30 and the outer bulb 31; for example, to render the influence of mains voltage variations on the luminous behaviour of the lamp small.

The further electrical connection of the lamp is not shown. This lamp is connected, for example via a stabilizing coil to an a.c. voltage mains. If the voltage of this supply mains increases somewhat, the temperature of the discharge tube 30 increases and consequently also the temperature of the getter 39. This will cause the getter to expel more hydrogen which increases the cooling of the discharge tube 30. Consequently the lumen value of the lamp of FIG. 2 depends only to a slight degree on mains voltage variations.

What is claimed is:

1. Gas and/or vapour discharge lamp provided with a discharge tube and an outer bulb which envelops this tube, means being present to change the heat insulation in the space between the discharge tube and the outer bulb, characterized in that this means consists of a reversible hydrogen getter which is located in the space between the discharge tube and the outer bulb of the lamp, whereby this getter releases hydrogen if its temperature increases and absorbs hydrogen if its temperature decreases.

2. A vapour discharge lamp as claimed in claim 1, characterized in that there is a temperature range of the discharge tube within which it holds that at a constant temperature the voltage-versus-current characteristic has a positive range, whilst — at a constant electrical voltage across the discharge tube — the discharge tube has, in its operating condition, a positive temperature-versus-current characteristic.

3. A device provided with a vapour discharge lamp as claimed in claim 2, characterized in that the lamp is a low pressure sodium vapour discharge lamp and that the reversible getter is located near a heating element which is included in an auxiliary circuit, whilst the magnitude of the current through the heating element depends on the magnitude of the current through the discharge tube, such that at a large current through the discharge tube a relatively large current flows through the heating element and that the connections of electrodes of the discharge tube to input terminals of the device are substantially free of stabilising ballasts.

4. A gas and/or vapour discharge lamp as claimed in claim 1, characterized in that the lamp is a high pressure metal vapour discharge lamp and that the reversible hydrogen getter is in an intimate heat contact with an end of the discharge tube.

* * * * *

UNITED STATES PATENT AND TRADEMARK OFFICE

CERTIFICATE OF CORRECTION

PATENT NO. : 4,004,171

DATED : January 18, 1977

INVENTOR(S) : JEAN JOHAN HEUVELMANS ET AL

It is certified that error appears in the above-identified patent and that said Letters Patent are hereby corrected as shown below:

Col. 1, line 44, "better" should be "between".

Col. 2, line 5, "imput" should be --input--.

Signed and Sealed this

Fifth Day of April 1977

[SEAL]

*Attest:*

RUTH C. MASON
*Attesting Officer*

C. MARSHALL DANN
*Commissioner of Patents and Trademarks*